US006736132B2

(12) United States Patent
Schlosser et al.

(10) Patent No.: US 6,736,132 B2
(45) Date of Patent: May 18, 2004

(54) OUTDOOR GAS FIREPLACE

(75) Inventors: Erich J. Schlosser, Barrington, IL (US); Adrian A. Bruno, Rolling Meadows, IL (US)

(73) Assignee: Weber-Stephen Products Co., Palatine, IL (US)

( * ) Notice: Subject to any disclaimer, the term of this patent is extended or adjusted under 35 U.S.C. 154(b) by 0 days.

(21) Appl. No.: 10/262,140

(22) Filed: Oct. 1, 2002

(65) Prior Publication Data

US 2004/0060554 A1 Apr. 1, 2004

(51) Int. Cl.[7] ..... F24C 3/00; F24C 5/00
(52) U.S. Cl. ..... 126/512; 126/503; 431/125
(58) Field of Search ..... 126/512, 503, 126/92 R, 92 AC; 431/125, 126, 88

(56) References Cited

U.S. PATENT DOCUMENTS

| | | | | | |
|---|---|---|---|---|---|
| 3,742,189 | A | | 6/1973 | Conroy et al. | |
| 3,805,762 | A | * | 4/1974 | Nelson | 126/506 |
| D293,191 | S | | 12/1987 | Stephen et al. | |
| 5,094,223 | A | | 3/1992 | Gonzalez | |
| 5,598,834 | A | | 2/1997 | Grady | |
| 5,645,043 | A | | 7/1997 | Long et al. | |
| 5,738,084 | A | * | 4/1998 | Hussong | 126/512 |
| 5,836,298 | A | | 11/1998 | Grady | |
| 5,848,585 | A | | 12/1998 | Long et al. | |
| 5,960,788 | A | | 10/1999 | Bach et al. | |
| D420,115 | S | | 2/2000 | Bach et al. | |
| 6,044,836 | A | * | 4/2000 | Oliver et al. | 126/92 AC |
| 6,065,467 | A | * | 5/2000 | Martin | 126/41 R |
| 6,142,143 | A | * | 11/2000 | Martin | 126/506 |
| 6,220,240 | B1 | | 4/2001 | Grady et al. | |
| 6,286,503 | B1 | | 9/2001 | Bach et al. | |
| 6,354,288 | B1 | | 3/2002 | McDonald | |
| D455,206 | S | | 4/2002 | Davis et al. | |
| 6,385,881 | B1 | | 5/2002 | Hess | |
| 6,439,225 | B2 | | 8/2002 | Bach et al. | |
| 6,488,025 | B1 | | 12/2002 | Cunningham | |
| 2001/0032642 | A1 | | 10/2001 | Bach et al. | |

OTHER PUBLICATIONS

Instruction Manual for Coleman Gas Log Patio Hearth, Model 5076 Series, The Coleman Company, Inc., 2001, pp. 1–8.

* cited by examiner

*Primary Examiner*—Alfred Basichas
(74) *Attorney, Agent, or Firm*—Wallenstein Wagner & Rockey, Ltd.

(57) ABSTRACT

A portable outdoor fireplace is provided. The portable outdoor fireplace has a housing that supports a gas burner, typically for heat, and a separate ornamental flame. The outdoor fireplace also has a moveable hood. A gas shut-off valve is manipulated based on the position of the hood.

4 Claims, 9 Drawing Sheets

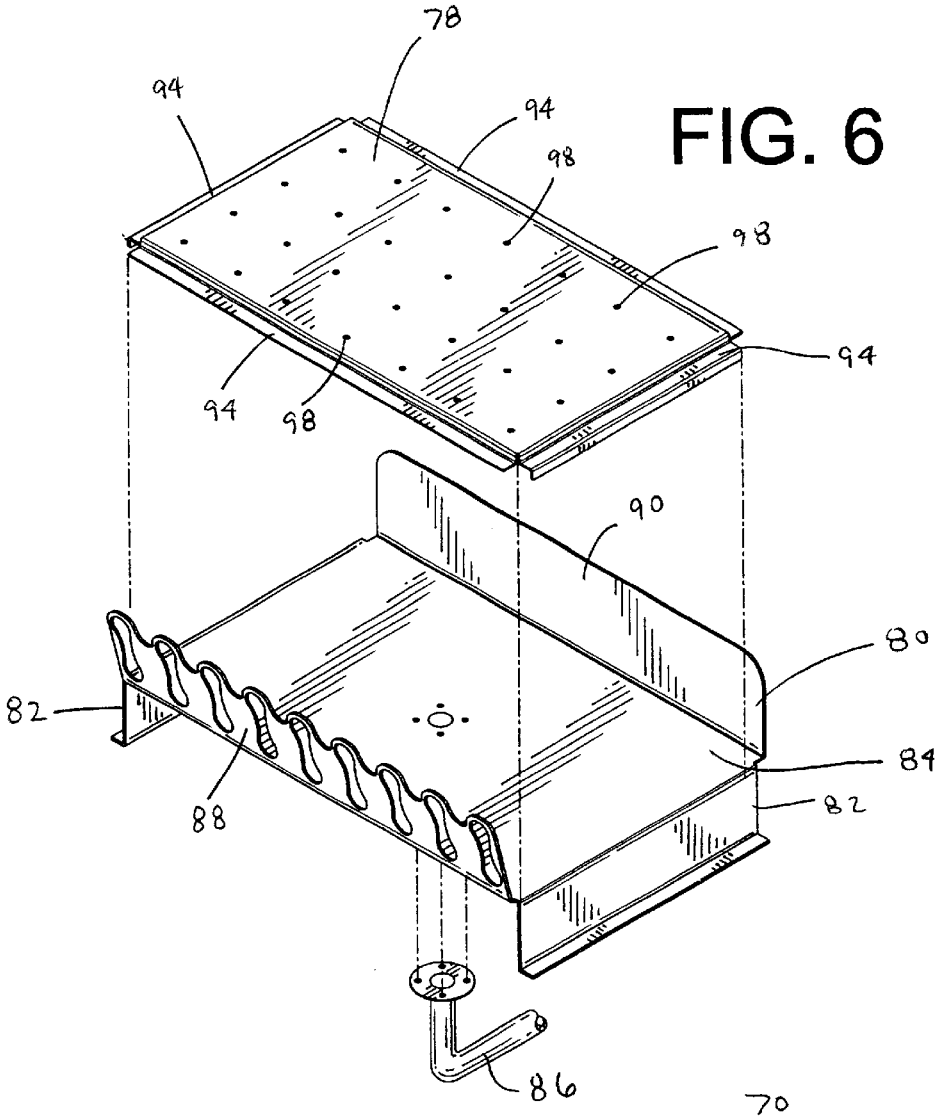
FIG. 6
FIG. 7
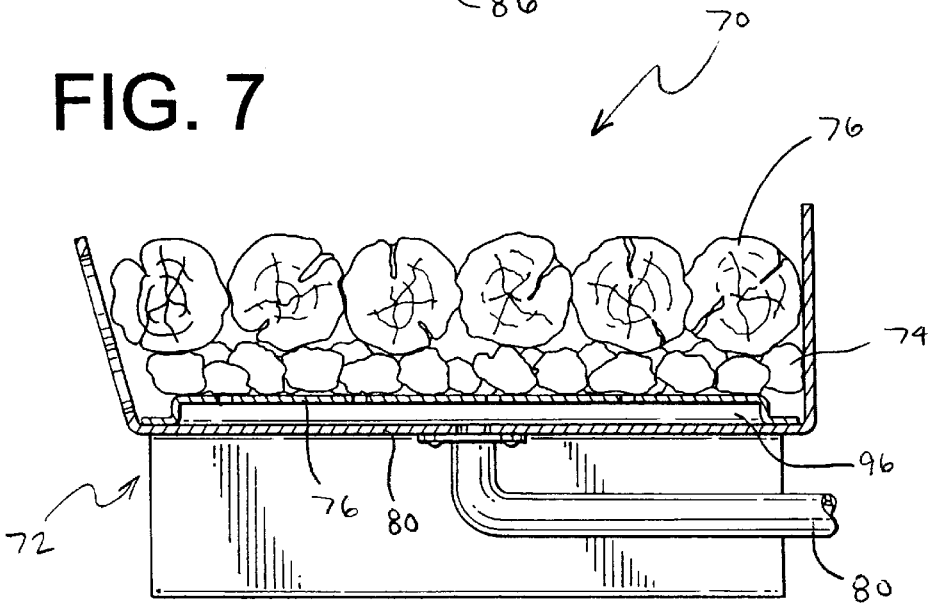

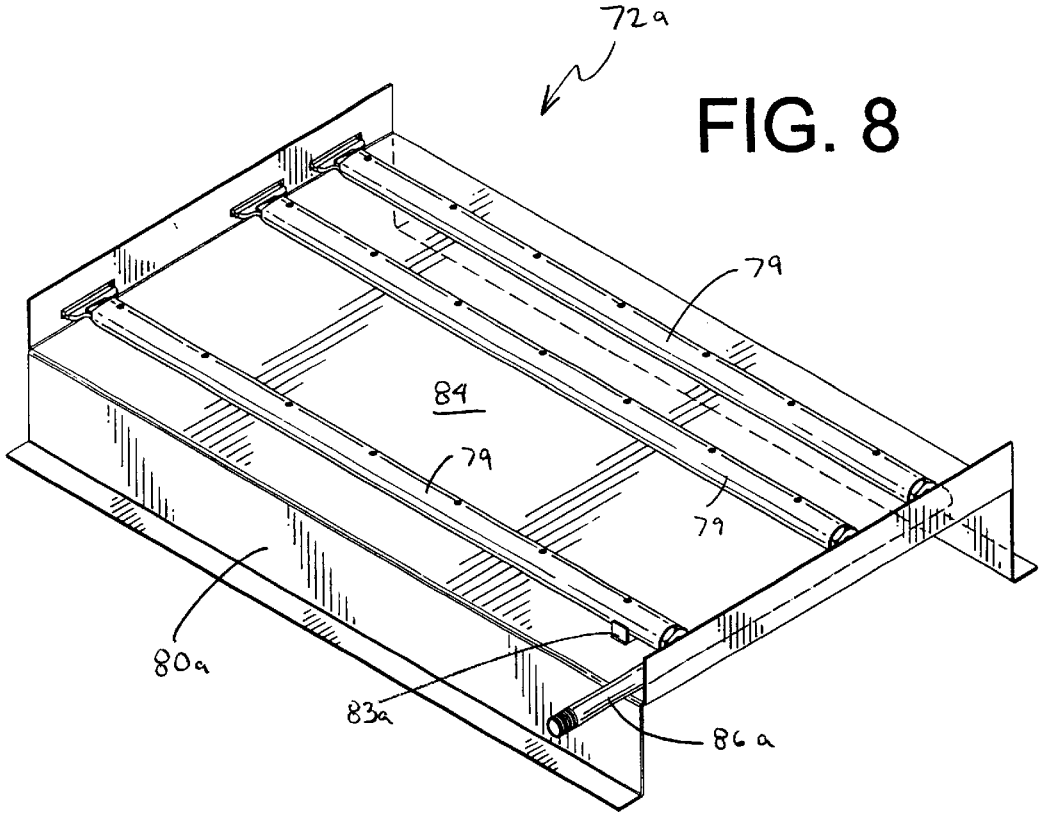
FIG. 8
FIG. 9
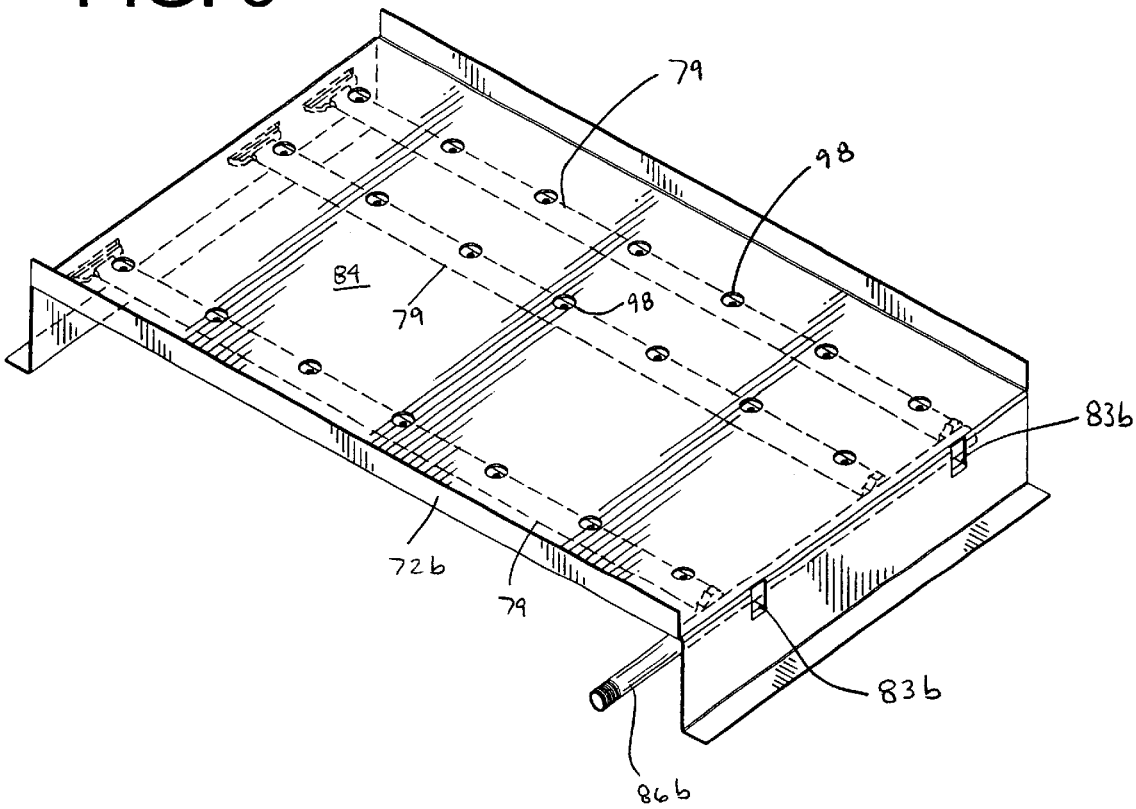

OUTDOOR GAS FIREPLACE

TECHNICAL FIELD

The present invention relates generally to the field of gas-fueled fireplaces, and more specifically to the field of portable gas-fueled outdoor fireplaces.

BACKGROUND OF THE INVENTION

Outdoor fire pits, fireplaces and heaters have been used by campers, homeowners and others to provide both outdoor heat and the aesthetically appealing appearance of a wood fire. Prior outdoor fire pits, fireplaces and heaters are generally grouped into three categories: (1) wood burning; (2) standard gas fueled; and (3) infrared radiation emitting. Further, prior outdoor fire pits, fireplaces and heaters are divided into permanent or stationary devices, such as those made from brick or masonry, and portable devices. However, each of these types of outdoor heaters/fireplaces have inherent limitations.

1. Wood Burning Fire Pits/Fireplaces:

U.S. Pat. No. Des. 293,191 (commonly assigned to Weber-Stephen Products Co.) discloses a portable outdoor fireplace. This design incorporates similarly shaped top and bottom portions of the well-known Weber kettle grill. The top and bottom covers are spaced apart by a framework to provide a wood burning area.

U.S. Pat. Nos. 5,598,834 and 5,836,294 disclose a portable outdoor fireplace with a convertible grill feature. The '834 patent discloses a portable outdoor wood burning fireplace with top and bottom housing members and a fire screen assembly extending vertically therebetween. The fire screen assembly is cylindrical and includes multiple screen panels. One of the screen panels is removable and insertable into the fire screen assembly and supported horizontally therein to provide a grill surface within the fire screen assembly which may be used for cooking. The '294 patent, a continuation-in-part patent of the '834 patent, discloses a similar device, however, one of the screen panels of the fire screen assembly is hinged to provide a side entrance to the fireplace.

While wood burning fire pits/fireplaces are aesthetically appealing, they have the inherent downsides of requiring an abundance of wood, as well as an initial start-up time and a cool down time. Further, wood burning fire pits/fireplaces require extensive cleanup from the ash and smoke produced during the burning process.

2. Standard Gas Fueled Fireplaces/Heaters

U.S. Pat. No. 5,848,585 discloses a forced air type portable gas space heater. The heater includes a base, an outer tubular housing and a burner assembly mounted within the outer housing. A fan is mounted within the outer housing behind the burner assembly. Fuel and combustion air is supplied to the burner assembly, forcing hot combustion gases from the burner assembly, and cooling the exterior of the burner assembly.

U.S. Pat. No. 5,094,223 discloses a gas started wood burning portable fire pit grill. This fire pit has a fire bowl base, a cylindrical wood receiving chamber defined by expanded metal walls above the fire bowl, a pair of separately controlled gas burners encircling the chamber adjacent its side wall, and a propane gas tank releasably connected to the apparatus and gas burners via a flexible hose and manual quick release coupling. Wood pieces are stacked into the chamber, and the gas burners project their flames horizontally internally toward the stacked wood pieces to advance their burning, at which time the propane gas may be disconnected and moved away.

Another commercially available gas fueled blue-flame type fireplace is distributed by the Coleman Company under the tradename "Gas Log Patio Hearth," model 5076 series. This device incorporates a conical shaped base that houses a standard 20 lb. propane tank. A fire pan having a gas burner ring is supported on the base, and a plurality of artificial logs are situated above the burner ring to provide a wood burning fire effect to the flame emitted from the gas burner.

Numerous other commercially available gas burning outdoor fireplaces are also available. Such devices operate under generally the same principal as the above-identified "Gas Log Patio Hearth," thereby including some form of a burner base, a gas burner, and a plurality of artificial logs. Unfortunately, while these gas fireplaces eliminate some of the downfalls associated with burning real wood, they do not provide a sufficient source of heat.

3. Infrared Radiation Emitting Heaters

Patio heaters that emit up to approximately 55,000 BTU's of radiant heat have been utilized for some time. Typically, such radiant heaters are mounted atop a vertical stand, often as high as 90" tall, and the fuel tank is located at the base of the vertical stand. A light-weight aluminum reflector dome is placed above the radiant heater to direct the radiant energy about approximately a fifteen foot diameter circle. While such heaters provide sufficient heat, they unfortunately do not provide the aesthetics of a fireplace.

Accordingly, a portable gas-fueled outdoor fireplace in accordance with the present invention provides an apparatus which eliminates the drawbacks of the prior outdoor fire pits/fireplaces/heaters described above.

SUMMARY OF THE INVENTION

The present invention provides a portable gas-fueled outdoor fireplace. The outdoor fireplace combines the aesthetics and heat of a natural wood fire with the simplicity and cleanliness of a gas fueled fireplace. Generally, the portable gas-fueled outdoor fireplace comprises an ornamental flame and a heat producing gas burner attached to a housing, and a hood moveably attached to the housing to cover the gas burner and the ornamental flame when the hood is in the closed position.

According to one aspect of the present invention, the ornamental flame is provided by a first gas burner in a first embodiment. In another embodiment, an artificial flame provides the ornamental flame emanating from the fireplace.

According to another aspect of the present invention, a second gas burner is provided. The second gas burner may emit radiant energy in a wavelength range that is transmitted to an area surrounding the fireplace. In one embodiment, the second gas burner comprises an infrared burner. In another embodiment, the second gas burner may comprise a plurality of infrared burner panels emitting infrared energy in a plurality of directions.

According to another aspect of the present invention, the second gas burner is distinct from the first gas burner, and produces energy in a second energy range, a portion of which is outside of the energy range of the gas burner. The first gas burner may comprise a substantially planar burner plate having a plurality of apertures and a cavity adjacent to the apertures, the cavity distributing fuel throughout the plurality of apertures in the burner plate. The first gas burner may further comprise a plurality of conductive members distributed on the burner plate, the conductive members dispersing a flame protruding from the apertures in the burner plate.

According to another aspect of the present invention, the outdoor fireplace further comprises a control valve in fluid communication with the first gas burner, the control valve controlling the flow of fuel from the supply to the burner. The outdoor fireplace may further comprises a second control valve in fluid communication with the second gas burner, controlling the flow of fuel from the supply to the second gas burner.

According to another aspect of the present invention, the outdoor fireplace further comprises an ignitor for the first gas burner. In one embodiment, where the ornamental flame is provided by the first gas burner, the outdoor fireplace further comprises a second ignitor for the second gas burner. The second ignitor is separated and independently controlled from the ignitor for the first gas burner.

According to another aspect of the present invention, the housing of the outdoor fireplace generally comprises a base member or bottom member. In one embodiment, the housing of the outdoor fireplace further comprises a transverse member attached to the base member, such that the transverse member is generally transverse to the base member. In this embodiment of the invention, the ornamental flame is mounted to the base member, and the second gas burner is mounted to the transverse member.

According to another aspect of the present invention, when the ornamental flame is provided by a first gas burner, the second gas burner emits energy in a direction generally transverse to the direction in which the first gas burner emits energy.

According to another aspect of the present invention, one or more transport members depend from the fireplace housing, the transport members support the fireplace housing and are adapted to provide portability to the outdoor fireplace. In one embodiment, the transport members are wheels connected to the fireplace housing.

According to another aspect of the present invention, the fuel supply comprises a tank supported by the housing.

According to another aspect of the present invention, the hood of the fireplace is moveable between a first position and a second position. In one embodiment, the hood is attached to the base member of the housing.

According to another aspect of the present invention, the fireplace further comprises a gas safety valve in fluid communication with the fuel supply, the gas safety valve being moveable from an open position to a closed position.

According to yet another aspect of the present invention, the outdoor fireplace further comprises a sensor that senses the position of the hood and manipulates the gas safety valve. The movement of the hood from the first position to the second position moves the safety valve from the open position to the closed position, thereby manipulating the supply of gas to the gas burners.

Other features and advantages of the invention will be apparent from the following specification taken in conjunction with the following drawings.

BRIEF DESCRIPTION OF THE DRAWINGS

To understand the present invention, it will now be described by way of example, with reference to the accompanying drawings in which:

FIG. 6 is an exploded view of the bottom burner of the outdoor fireplace of FIG. 1;

FIG. 7 is a side view of the bottom burner of the outdoor fireplace of FIG. 1;

FIG. 8 is an alternate embodiment of the bottom burner of the outdoor fireplace of FIG. 1;

FIG. 9 is another alternate embodiment of the bottom burner of the outdoor fireplace of FIG. 1;

DETAILED DESCRIPTION OF THE PREFERRED EMBODIMENT

Figure 1:
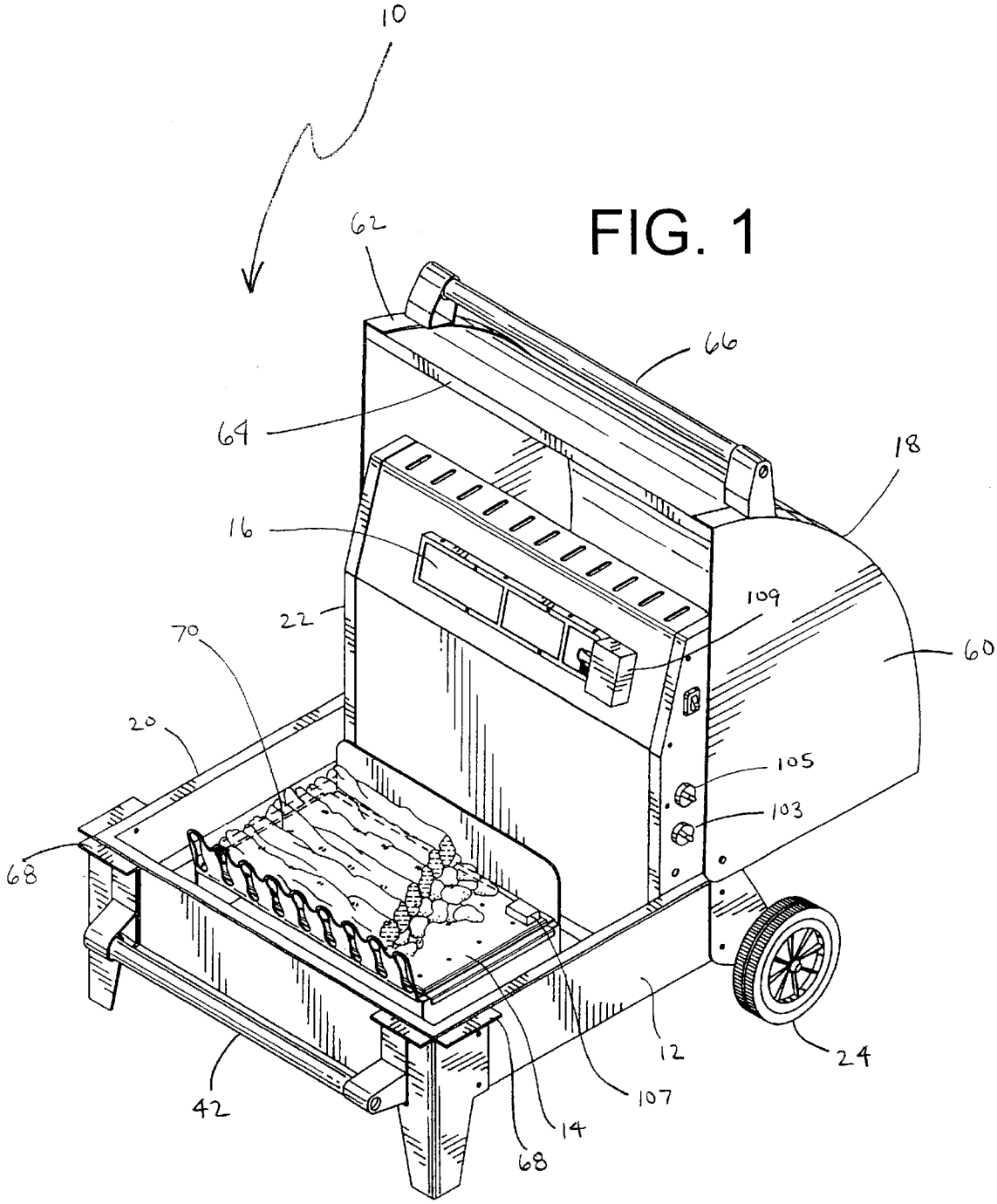
FIG. 1 is a perspective view of the outdoor fireplace of the present invention.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Referring now to the Figures, and specifically to FIG. 1, there is shown an outdoor fireplace 10 of the present invention. The outdoor fireplace 10 has a fireplace housing 12, a first flame assembly 14 and a second flame assembly 16. A hood 18 depends from the fireplace housing 12. Generally, the fireplace housing 12 supports at least one flame assembly, however, one of ordinary skill in the art would understand that additional flame assemblies may be incorporated into the outdoor fireplace 10 without departing the scope of the invention.

Figure 4:
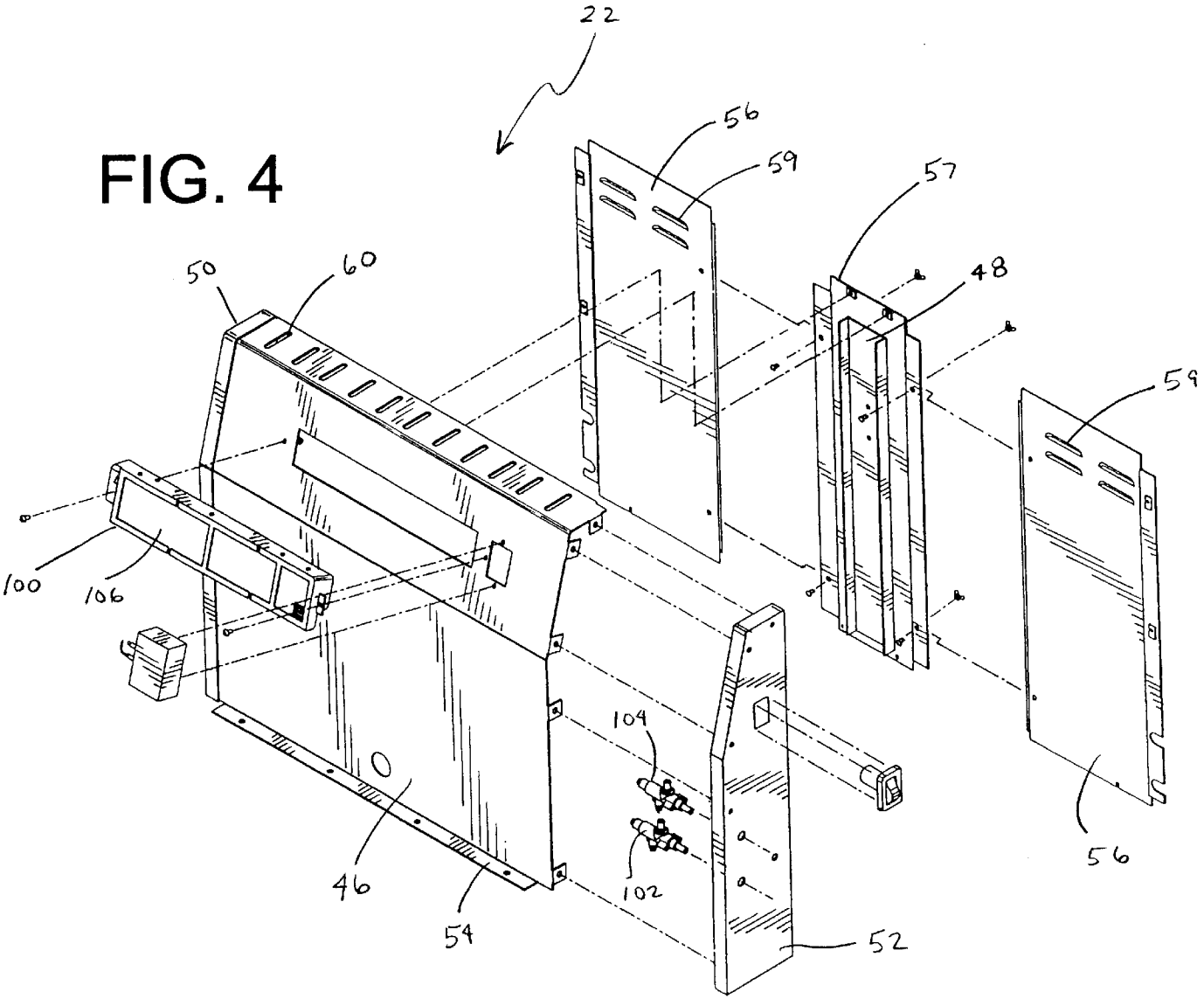
FIG. 4 is an exploded view of the back wall assembly of the outdoor fireplace of FIG. 1.
Figure 5:
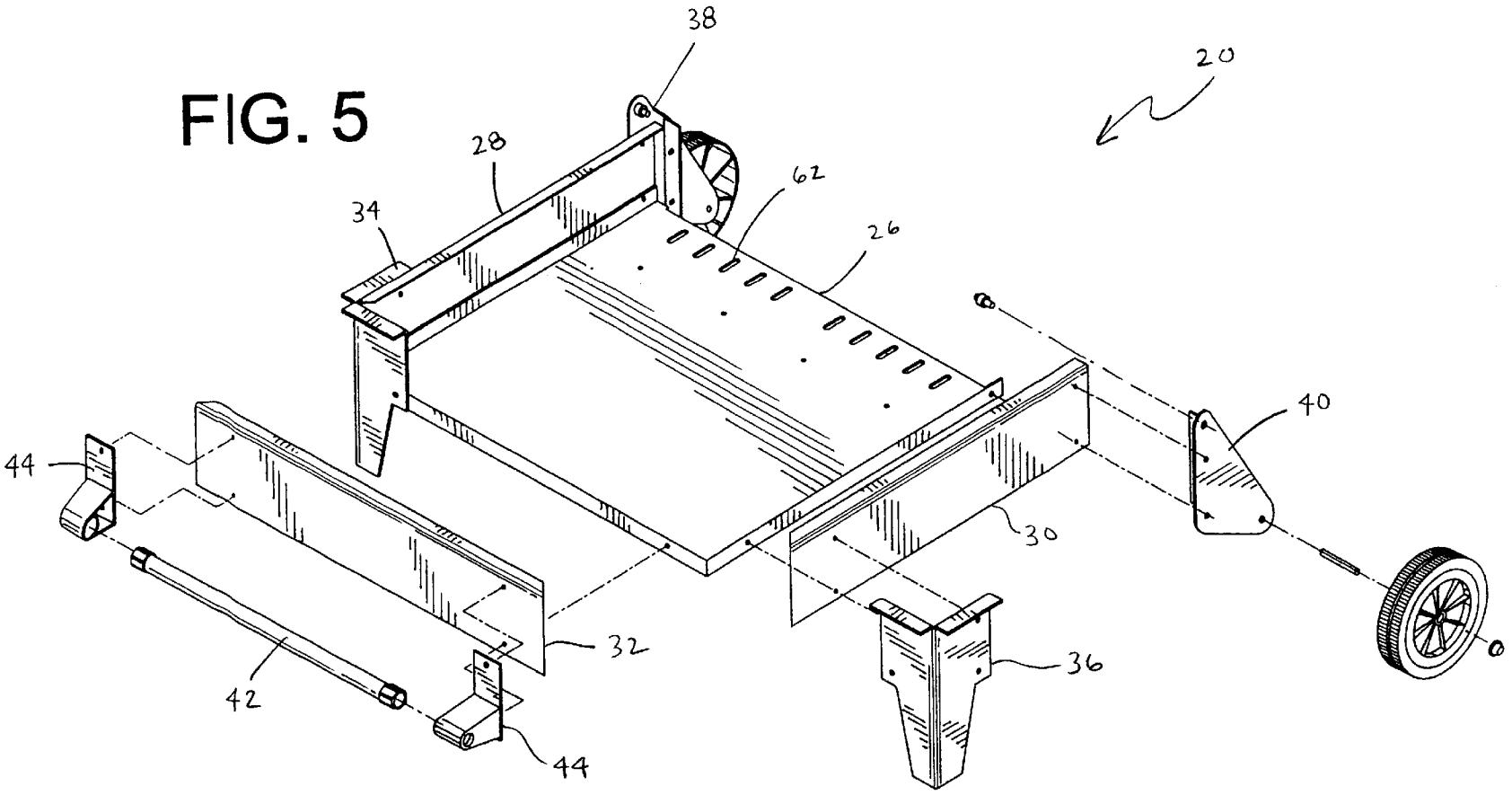
FIG. 5 is an exploded view of the base assembly of the outdoor fireplace of FIG. 1.

As shown in FIGS. 1, 4 and 5, the fireplace housing 12 in one embodiment comprises a first housing member 20 and a second housing member 22. Generally, the first flame assembly 14 is mounted to the first housing member 20, and the second flame assembly 16 is mounted to the second housing member 22. Additionally, a transport member 24 depends from the fireplace housing 12. The transport member 24 supports a portion of the fireplace housing 12, and it also assists in providing portability to the outdoor fireplace 10. In a preferred embodiment, the transport member 24 comprises a wheel.

The first housing member 20 of the outdoor fireplace 10 of the present embodiment functions as a base member. In such an embodiment shown in FIG. 5, the first housing member 20 has a bottom panel 26, opposing first and second side panels 28, 30, a front panel 32, opposing first and second front legs 34, 36 and first and second opposing rear legs 38, 40. During manufacture, the first front leg 34 is secured to the first side panel 28, the front panel 32 and the bottom panel 26 with the use of fasteners. Similarly, the second front leg 36 is secured to the second side panel 30, the front panel 32 and the bottom panel 26 with the use of fasteners. Next, the first rear leg 38 is secured to the first side panel 28 and the bottom panel 26, and the second rear leg 40 is secured to the second side panel 30 and the bottom panel 26, with fasteners. In a preferred embodiment the components of the first housing member 26 are made of sheet material, specifically bent sheet metal, however, one having skill in the art would appreciate that these components may be made and assembled in a variety of ways, including, but not limited to, castings, weldments, forgings, etc. Finally, a handle 42 is mounted to the first housing member 20. In the embodiment illustrated in FIG. 5, the handle is mounted to the first housing member 20 with the use of first and second holders 44 that are fixed to the front legs 34, 36. Additionally, a wheel 24 is rotatedly secured to the first and second rear legs 38, 40, respectively. As such, the outdoor fireplace 10 can be easily moved.

The second housing member 22 (also referred to as a transverse member because of its orientation in various embodiments) of the outdoor fireplace 10 of the present embodiment is positioned transverse to the base member 20, and has a front member 46, a rear member 48 and opposing first and second side members 50, 52. During manufacture, the second housing member 22 is mounted to the first housing member 20. Specifically, the front member 46 is connected to the rear member 48 at a top end of each member. Then, the first side member 50 is secured to one side of the front member 46, and the second side member 52 is secured to the opposing side of the front member 46. Finally, the front member 46 of the second housing member 22 is secured to the bottom panel 26 of the first housing member 20 with fasteners that extend through a lip 54 of the front member 46, the rear member 48 of the second housing member 22 is secured to the bottom panel 26 of the first housing member 20 with fasteners, and the first and second side members 50, 52 are secured to the bottom panel 26 of the first housing member 20 with the use of fasteners. As with the first housing member 30, in a preferred embodiment the components of the second housing member 22 are made of sheet material, specifically bent sheet metal, however, one having skill in the art would appreciate that these components may be made and assembled in a variety of ways, including, but not limited to, castings, weldments, forgings, etc.

The second housing member 22 has a plurality of apertures 60 in the top of the front member 46. Similarly, as shown in FIG. 5, the first housing member 20 has a plurality of apertures 62 in the bottom panel 26. Additionally, the rear member 48 has a plurality of apertures 59. The apertures 59, 60, 62 allow heat to escape out of the internal cavity of the second housing member 22. Further, by having apertures at the top and bottom of the internal cavity of the second housing member 22, a chimney effect is provided to cool down the interior of the second housing member 22.

Figure 3:
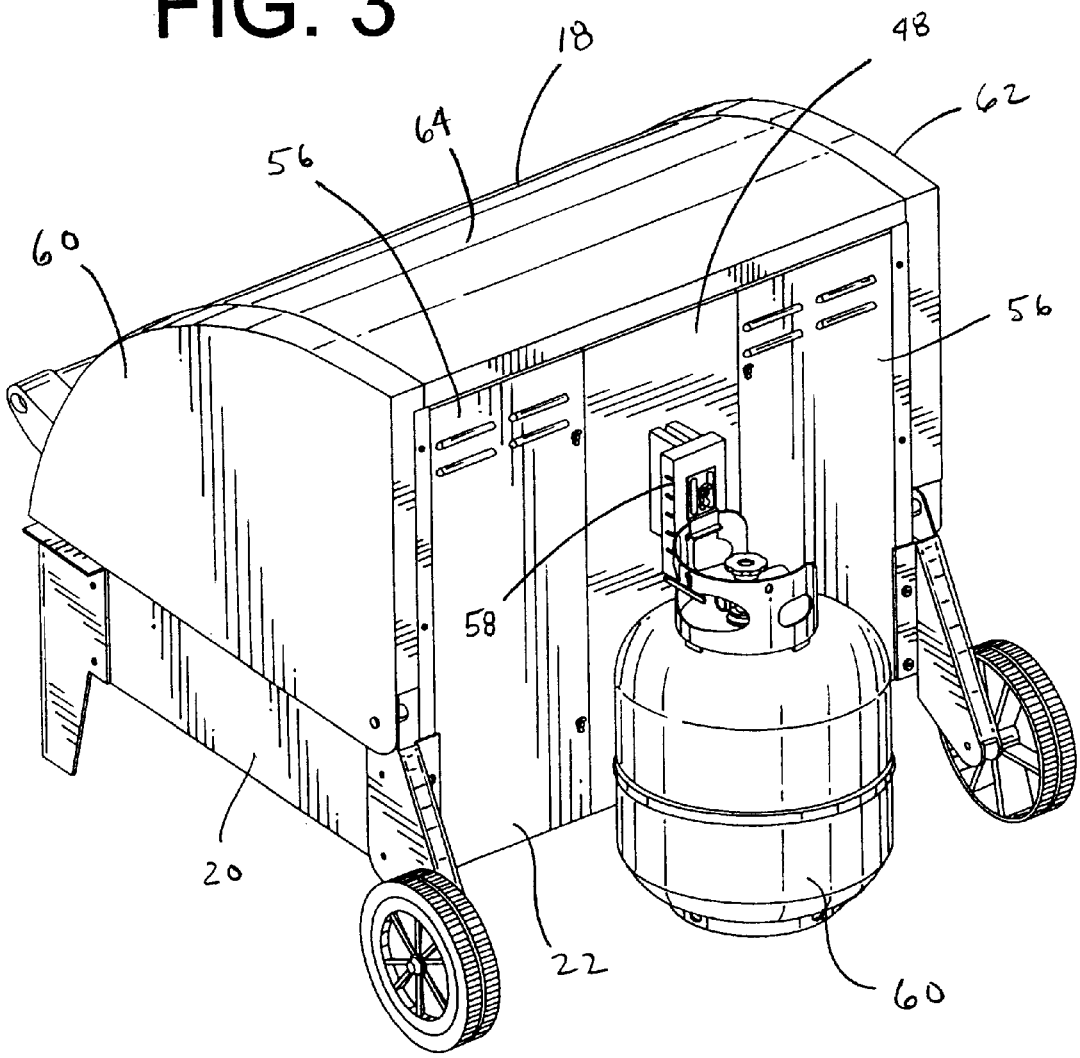
FIG. 3 is a perspective view of the rear of the outdoor fireplace of FIG. 1.

The rear member 48 of the second housing member 22 has a plurality of bent lips that increase the rigidity of the rear member 48 and allow the rear member 48 to operate as a bracket. As shown in FIG. 3, the rear member 48 supports a tank scale 58, which in turn supports a fuel tank 60 that provides fuel to the flame assemblies. In the preferred embodiment, the supply of fuel for either or both of the flame assemblies 14, 16 is provided by fuel in the fuel tank 60. However, other supplies of fuel, including, but not limited to natural gas, may be provided without departing from the scope of the present invention.

Opposing access panels 56 are provided in the rear of the second housing member 22 to provide access to the interior of the second housing member 22. The access panels 56 are located adjacent the rear member 48 and form a portion of the rear wall of the second housing member 22. The access panels 56 have a lip 57 which engages opposing first and second side members 50, 52, respectively. Additionally, the access panels 56 have a hole through which a threaded hand bolt can pass through to removably secure the access panels 56 to the rear member 48.

Figure 2:
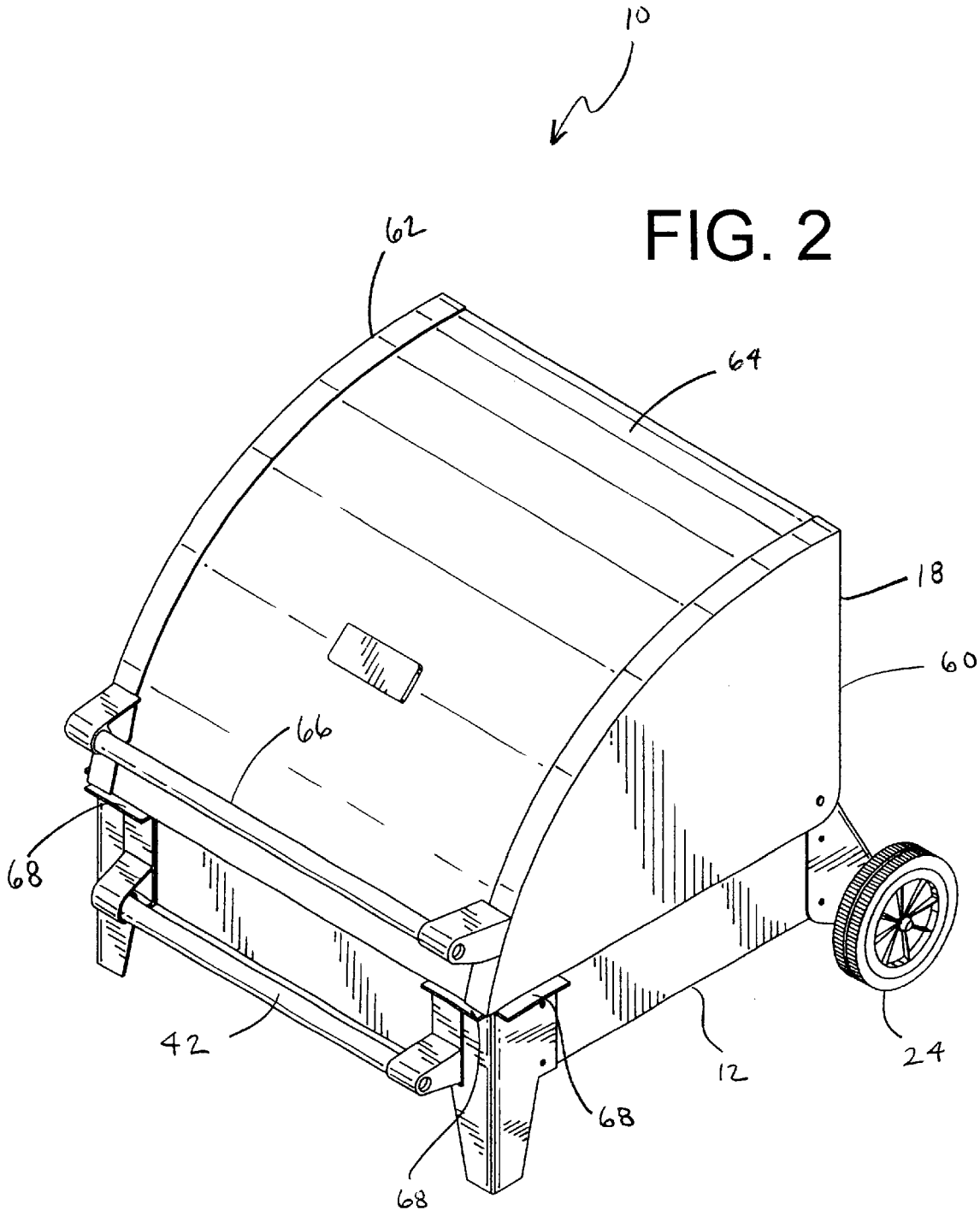
FIG. 2 is a perspective view of the outdoor fireplace of FIG. 1, with the hood closed.

As shown in FIGS. 1–3, the moveable hood 18 or lid depends from the fireplace housing 12 and is moveable between a first position (generally shown in FIG. 1) to a second position (generally shown in FIG. 2). The hood 18 is generally comprised of first and second end caps 60, 62 with a central member 64 therebetween. In a preferred embodiment, the first end cap 60 is rotatably secured to the first rear leg 38, and the second end cap 62 is rotatably secured to the second rear leg 40. The hood 18 also has a handle 66 for opening and closing the hood 18. The handle 66 is mounted at opposing ends to the first and second end caps 60, 62. As shown in FIG. 2, the first and second front legs 34, 36 have a ledge 68 on which the hood 18 rests when the hood 18 is in the second or closed position.

In one embodiment of the outdoor fireplace 10, the first flame assembly 14 provides an ornamental flame 70. The ornamental flame 70 provides the appearance of a wood-burning fire to the outdoor fireplace 10. The ornamental flame 70 may be provided by an artificial flame, such as a decorative flame comprising a fire-like rendition including a colored plastic, paper or any other type of apparatus that provides an artificial but realistic appearing flame, by a separate gas burner, by a carbon-burning element, or by any means which provides the appearance of a wood-burning fire. As such, the ornamental flame may or may not be comprised of a burning flame.

As shown in FIGS. 1 and 7, in a preferred embodiment the ornamental flame 70 of the first flame assembly 14 is provided by a flame from a first gas burner 72. In the preferred embodiment, the flame of the first gas burner 72 is provided by in a blue flame mode. Typically, blue flames release the majority of its energy through convection. The first gas burner 72 is generally mounted to the first housing member 20 of the fireplace housing 12. The first gas burner 72 in this embodiment has dispersing components 74, 76 thereon to disperse the gas flame, thereby providing the appearance of a wood-burning fire. In one embodiment, illustrated in partial cross-section in FIG. 7, the dispersing components include a plurality of lava rock 74 and a plurality of artificial logs 76, however it is not necessary to have both lava rock 74 and artificial logs 76. The use of either lava rock or artificial logs, or some other component capable of dispersing a flame, is acceptable. Generally, the lava rock 74 are disposed on the first gas burner 72, and the artificial logs 76 are disposed on the lava rock 74. In such a configuration, the artificial logs 76 are located on the lava rock 74 to further disperse the flame and to provide the appearance of a wood-burning fire.

One embodiment of the first gas burner 22 is illustrated in FIGS. 6 and 7. The first gas burner 72 comprises a burner plate 78 and a burner base 80. The burner base 80 is connected to the fireplace housing 12, and the burner plate 78 is mounted to a top of the burner base 80. Further, the burner base 80 has elevation members 82 which raise a surface 84 of the gas entrapment cavity 96 of the first burner 72 a distance above the bottom panel 26 of the first housing member 20 to allow a manifold 86 to pass underneath the first gas burner 72 and supply gas to the first burner 72. The elevation members 82 may be secured to the bottom panel 26 of the first housing member 20 to secure the first gas burner 22 in place. The burner base 80 further has a series of grate-like protrusions 88 adjacent a front of the burner base 80 to provide the appearance of a wood burning fireplace grate. Finally, a wall 90 depends from a rear of the burner base 80 to provide support for the dispersing components 74, 76.

The burner plate 78 comprises a member having a substantially planar surface 92, with shoulders 94 extending outwardly and downwardly therefrom. As such, when the burner plate 78 is positioned on the burner base 80, the substantially planar surface 92 of the burner plate 78 is raised off the burner base 80, thereby creating a cavity 96 between the burner plate 78 and the burner base 80. The burner plate 78 further has a plurality of apertures 98. Thus, fuel is supplied to the cavity 96 from the manifold 86, and as the fuel accumulates it fills the cavity 96 and is dispersed therefrom through the apertures 98 in the burner plate 78. Because of the heat generated, the burner plate 78 and burner base 80 of this embodiment are typically manufactured of stainless steel.

Another embodiment of the first gas burner 72*a* is illustrated in FIG. 8. In this embodiment, a burner plate 78 is not utilized. Instead, at least one burner tube 79 having a plurality of apertures 98 is utilized with a modified burner base 80*a*. Further, in the embodiment illustrated, three burner tubes 79 are incorporated into the design. The burner tubes 79 are positioned directly above the upper surface 84 of the burner base 80*a*. In such a configuration, the burner base 80*a* may be manufactured of a material other than stainless steel. The burner tubes 79 are secured at one end to the burner base 80*a*, and at the other end to a manifold 86*a*. The manifold 86*a* is then connected in fluid communication with the first control valve 102. Tabs 83*a* depending from the burner base 80*a* assist in locating and securing the burner 72, including the burner tubes 79 and manifold 86*a*, in place. Additionally, dispersing components (not shown), such as lava rock and artificial logs are placed over the burner tubes 79 to disperse the gas flame, thereby providing the appearance of a wood-burning fire.

Yet another embodiment of the first gas burner 72*b* is illustrated in FIG. 9. Similar to the embodiment of FIG. 8, in this embodiment, a burner plate 78 is not utilized. Rather, at least one burner tube 79 having a plurality of apertures is utilized with a modified burner base 80*b*. Further, in the embodiment illustrated, three burner tubes 79 connected to a manifold 86*a* are incorporated into the design. The burner tube 79 and manifold 86*a* assembly in this embodiment may be identical to the burner tube 79 and manifold 86*a* assembly disclosed above. Unlike the above embodiment, the burner tubes 79 of the embodiment in FIG. 9 are positioned directly below the upper surface 84 of the burner base 80*b*. In such a configuration, the burner base 80*b* has a plurality of apertures 81 that mate with the apertures 98 of the burner tubes 79, and the burner base 80*b* may be similarly manufactured of a material other than stainless steel. The burner tubes 79 are secured at one end to the burner base 80*b*, and at the other end to the manifold 86*b*. The manifold 86*b* is then connected in fluid communication with the first control valve 102. Tabs 83*b* depending from the burner base 80*a* assist in locating and securing the burner 72, including the burner tubes 79 and manifold 86*b*, in place beneath the upper surface 84 of the burner base 80*b*. Additionally, dispersing components (not shown), such as lava rock and artificial logs are placed over the burner tubes 79 to disperse the gas flame, thereby providing the appearance of a wood-burning fire.

The second flame assembly 16, as shown in FIGS. 1 and 4, generally comprises a second burner 100 connected to the fireplace housing 12. In one embodiment, the second burner 100 is mounted to the transverse member 22. Both the first gas burner 72 and the second burner 100 are in fluid communication with the fuel supply.

Typically, the second burner 100 is a distinct type of burner from the first burner 72. In a preferred embodiment, the first burner 72 produces energy within a first range of wavelengths of the electromagnetic spectrum, and the second burner 100 produces energy within a second range of wavelengths of the electromagnetic spectrum. Moreover, the second wavelength range produced by the second burner 100 has a portion thereof which is outside that of the first wavelength range. Additionally, based on the configuration of the fireplace housing 12, the first gas burner 72 emits its energy in generally a first direction, and the second gas burner 100 emits its energy in a second direction which is transverse to the first direction of emitted energy from the first gas burner 72.

In a preferred embodiment, the second burner 100 is an infrared gas burner. Infrared heat energy, a form of radiation, produced by the infrared gas burner 100 is transferred via electromagnetic energy through space by means of electromagnetic waves (i.e., light waves that include visible and invisible waves). As such, the radiant heat from the infrared burner 100 is a form of energy that heats objects directly through a conversion process without having to heat the air in between. More specifically, the infrared burner 100 produces energy within the segment of the electromagnetic spectrum that falls between visible light and radar, and it is divided into 3 segments by wavelength: (1) the first segment is the near or close segment and the wavelengths are in the range of 0.076 microns to 1.5 microns; (2) the second segment is the middle or intermediate segment and the wavelengths are in the range of 1.5 microns to 5.6 microns; and, (3) the third segment is the far or long-wave segment and the wavelengths are in the range of 5.6 microns to 1,000 microns. Thus, as one of ordinary skill in the art understands, the infrared burner 100 does not radiate "heat," rather an infrared burner 100 radiates a certain wavelength of electromagnetic waves that strikes an object, thereby exciting the surface molecules of the object and causing them to vibrate. The heat generated by the increase of the motion of the surface molecules spreads to the interior of the object through conduction, resulting in the solid heating up.

The infrared gas burner 100 of the present invention utilizes natural gas or liquid petroleum gas as the gas for combustion. In the preferred embodiment, the infrared gas burner 100 utilizes the combustion heat to heat a ported ceramic surface 106, however, other surfaces such as most perforated steel or certain wire meshes as are known in the industry may also be utilized. This ported surface 106 then releases a proportion of the infrared heat energy as explained above. Conversely, gas burners such as that found in the preferred embodiment of the first gas burner 72, produce blue flames which hover above the surface and release the majority of the energy through convection and not radiation. Further, while it is understood by those having ordinary skill in the art that infrared gas burners produce both infrared radiant heat and convective heat, infrared burners deliver a higher percentage of radiant heat and a lower percentage convective heat than blue flame gas burners.

In a preferred embodiment, a blue flame operating first gas burner 72 operates at about 45,000 to 55,000 BTU's, and the infrared second gas burner 100 operates at about 10,000 to 20,000 BTU's. As such, the total BTU's for the fireplace 10 when both burners 72,100 are operating is approximately 55,000 to 75,000 BTU's. At this operating range, the outdoor fireplace 10 should have a running time of approximately 5to 6 hours on a single propane tank.

Figure 10:
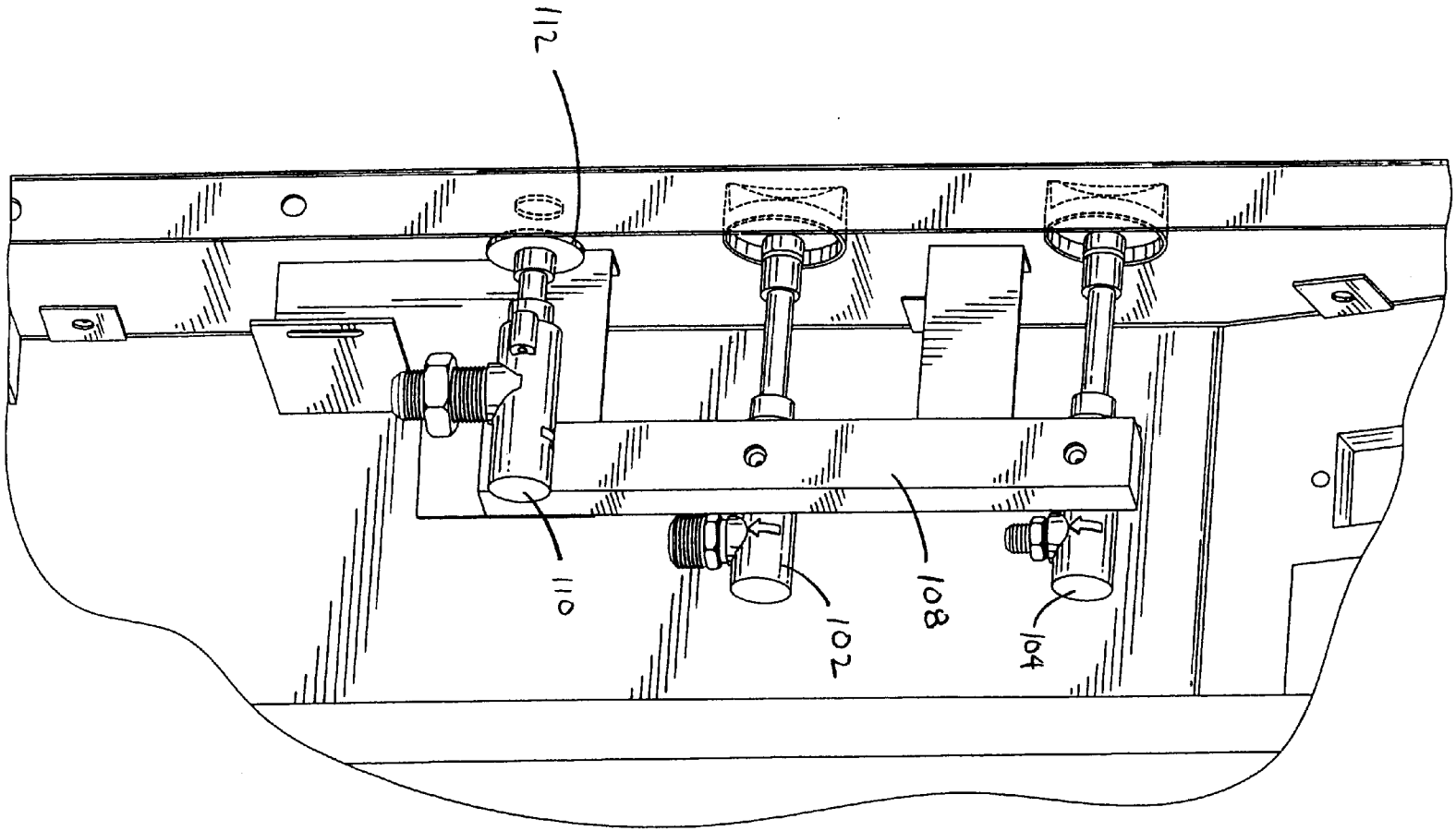
FIG. 10 is a partial perspective view of the manifold assembly of the outdoor fireplace of FIG. 1; and, FIG. 11 is an enlarged perspective view of the gas shut off assembly illustrated in FIG. 10.

Valves control the flow of fuel to the first and second burners 72, 100. As shown in FIG. 10, in the preferred embodiment, there are separate control valves 102, 104 for each of the first and second burners 72, 100 respectively. The first control valve 102 is in fluid communication with the first burner 72 and controls the flow of fuel to the first burner 72, and the second control valve 104 is in fluid communication with the second burner 100 and controls the flow of fuel to the second burner 100. The first and second control valves 102, 104 are fluidly connected to the main manifold 108. The main manifold 108 is secured to an inside of the second housing member 22, and is accessible though removal of the access panel 63. Fuel from the gas supply 60 flows to the main manifold 108 through the gas shut off valve 110.

The control valves 102, 104 are operated via control knobs 103, 105 on the outside of the fireplace housing 20. The control knobs 103, 105 independently control the flow of fuel to the gas burners 72, 100, to independently control the heat dispersed from each burner, respectively. Additionally, each burner 72, 100 has an independent ignitor 107, 109 for igniting the respective burners.

Figure 11:
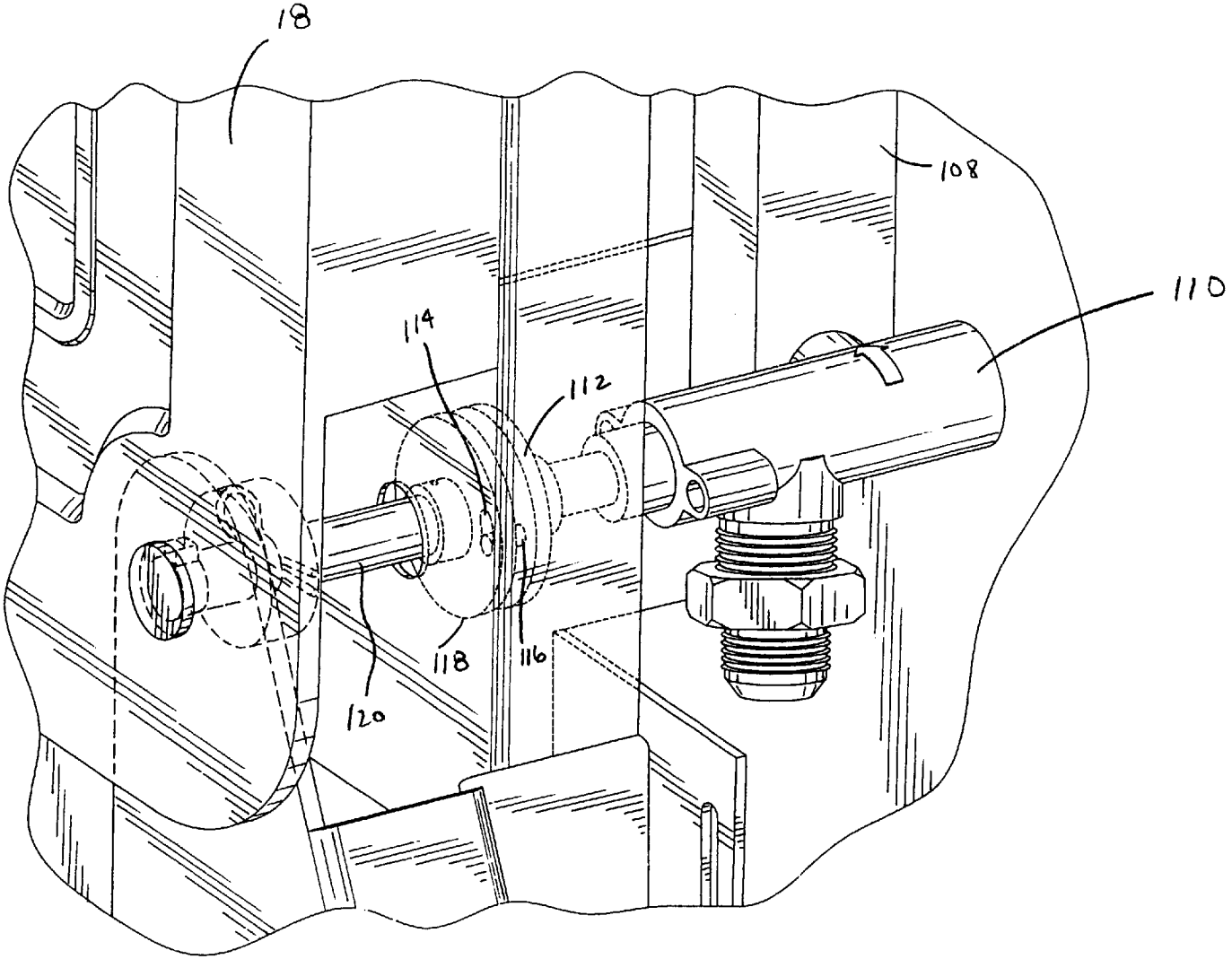

As shown in FIGS. 10 and 11, the gas shut off valve 110 for the outdoor fireplace 10 is connected to the main manifold 108. The gas shut off valve 110 is provided to ensure that fuel is shut off to the burners of the fireplace 10 when the lid of the fireplace is closed. The gas shut off valve 110 is manipulated by opening and closing of the hood 18. In one embodiment, the gas shut off valve 110 comprises a rotatable disk 112 which rotates to open and close the gas shut off valve 110. The rotatable disk 112 has slots 114 which engage pins 116 on a disk 118 connected to the rotating shaft 120 supporting the hood 18. Further, the rotating shaft 120 that supports the hood 18 is fixedly secured to the hood 18. As such, when the hood 18 is moved from the first position to the second position (i.e., when the hood is opened and closed), the shaft 120 rotates, and the pins 116 on the shaft 120 engage the disk 112, thereby manipulating the gas shut off valve 110. A sensor (not shown) may also be employed to sense the position of the hood and thereby manipulate opening and shutting of the gas shut off valve accordingly. Nevertheless, it is understood by one of ordinary skill in the art that numerous processes for manipulating the gas shut off valve are possible without departing from the scope of the invention.

While the specific embodiments have been illustrated and described, numerous modifications come to mind without significantly departing from the spirit of the invention, and the scope of protection is only limited by the scope of the accompanying Claims.

What is claimed is:

1. An outdoor fireplace adapted to be connected in fluid communication with a gas supply, comprising:

a fireplace housing having a burner in fluid communication with the gas supply, and further comprising a moveable hood, the hood being connected to the fireplace housing and moveable between a first position and a second position, and a gas safety valve being moveable from an open position to a closed position, and wherein the movement of the hood from the first position to the second position operates to have the gas safety valve adjusted from the open position to the closed position to shut off the supply of gas from the gas supply.

2. A gas fueled outdoor fireplace, comprising:

a fireplace housing supporting a gas burner;

a valve in fluid communication with the gas burner, the valve being moveable from an open position to a closed position, and the valve controlling the flow of fuel from a gas supply to the burner; and, a moveable hood connected to the fireplace housing, the hood being moveable from a first position to a second position, wherein the hood generally covers the gas burner in the second position, and wherein the valve is manipulated to the closed position to shut off the gas supply to the burner when the hood is positioned in the second position.

3. The gas fueled outdoor fireplace of claim 2, further comprising a sensor connected to the hood, wherein the sensor senses the position of the hood and manipulates the valve, such that when the hood is in one of the first position or the second position the valve is in the open position, and such that when the hood is in the other one of the first position or the second position, the valve is in the closed position.

4. A gas fueled outdoor fireplace, comprising:

a fireplace housing having a base member, a hood rotatably secured to the housing, the hood rotating from an open position to a closed position, a gas burner depending from the base member of the fireplace housing, and a gas safety valve being moveable from an open position to a closed position, wherein the movement of the hood from the first position to the second position operates to have the gas safety valve adjusted from the open position to the closed position to shut off gas from a gas supply.

* * * * *